US011421565B1

(12) United States Patent
Holihan et al.

(10) Patent No.: US 11,421,565 B1
(45) Date of Patent: Aug. 23, 2022

(54) CONTROL SYSTEM AND METHOD TO MITIGATE REVERSE OIL FLOW TO THE COMBUSTION CHAMBER ON DEACTIVATED CYLINDERS

(71) Applicants: Michael J. Holihan, Woodstock, GA (US); Patrick J. Derbin, Milford, MI (US)

(72) Inventors: Michael J. Holihan, Woodstock, GA (US); Patrick J. Derbin, Milford, MI (US)

( * ) Notice: Subject to any disclaimer, the term of this patent is extended or adjusted under 35 U.S.C. 154(b) by 0 days.

(21) Appl. No.: 17/657,349

(22) Filed: Mar. 30, 2022

(51) Int. Cl.

| | |
|---|---|
| ***F01M 1/16*** | (2006.01) |
| ***F02D 41/40*** | (2006.01) |
| ***F01M 11/00*** | (2006.01) |
| ***F01M 1/02*** | (2006.01) |
| ***F01M 1/08*** | (2006.01) |
| ***F02D 41/00*** | (2006.01) |
| ***F01M 1/18*** | (2006.01) |
| ***F02B 75/18*** | (2006.01) |
| ***F01M 5/00*** | (2006.01) |
| ***F02D 41/20*** | (2006.01) |

(52) U.S. Cl.
CPC ..... *F01M 1/16* (2013.01); *F01M 1/02* (2013.01); *F01M 1/08* (2013.01); *F01M 1/18* (2013.01); *F01M 5/002* (2013.01); *F01M 11/0004* (2013.01); *F02B 75/18* (2013.01); *F02D 41/008* (2013.01); *F02D 41/20* (2013.01); *F02D 41/40* (2013.01); *F02B 2075/1808* (2013.01)

(58) Field of Classification Search
CPC .. F01M 1/16; F01M 1/02; F01M 1/08; F01M 5/002; F01M 11/0004; F02B 75/18; F02B 2075/1808; F02D 41/008; F02D 41/20; F02D 41/40
See application file for complete search history.

(56) References Cited

U.S. PATENT DOCUMENTS

| | | | | |
|---|---|---|---|---|
| 8,746,193 | B2 * | 6/2014 | Bowler | F01M 1/16 123/41.35 |
| 9,556,764 | B2 * | 1/2017 | Claywell | F01P 3/08 |
| 2016/0305364 | A1 * | 10/2016 | Leone | F01M 1/08 |

* cited by examiner

*Primary Examiner* — Syed O Hasan

(57) ABSTRACT

This disclosure generally relates to an oil mitigation system and method for lubricating the piston(s) for electronic fuel injected internal combustion engines, incorporating cylinder deactivation technology. This concept leverages the engine's base fuel injection pulse width table, determines the fuel injection "shutoff" state and, reduces the oiling to counter the reverse oil flow effect within the cylinder wall, past the ring set to the cylinder combustion chamber. This disclosure further comprises a system and method for mitigating oil consumption to all active cylinders, for accommodating all ranges of engine loading.

9 Claims, 3 Drawing Sheets

CONTROL SYSTEM AND METHOD TO MITIGATE REVERSE OIL FLOW TO THE COMBUSTION CHAMBER ON DEACTIVATED CYLINDERS

BACKGROUND

The majority of compression-ignition and spark-ignition internal combustion engines utilize an oil delivery system via oil delivery tubes through piston flow nozzles. Excessive piston oiling occurs in large part because original equipment manufacturers design oiling systems for worst-case conditions and, in particular, have limited means to reduce oiling for a cylinder-deactivated state, a light engine load state and/or, idle periods.

A system to improve fuel economy and vehicle emissions has been developed, known as Cylinder Cutout (CCO) and more recently, a method introduced to improve cylinder pumping losses called Cylinder Deactivation (CDA), to shutoff cylinder injection during light load conditions. CDA is accomplished by turning off valve motion, fuel injectors, and spark ignition in a single or multiple cylinders. In contrast, CCO only turns off the fuel injectors to predetermined cylinders. In both CCO and CDA, a non-firing cylinder creates a lower cylinder gas pressure and may result in oil leakage past the top compression ring's end gap, and into the combustion chamber. The longer a cylinder remains in a "deactivated" state, the complete cylinder wall and piston assembly becomes cooler and promotes oil consumption issues. The tolerances increase as the parts cool down and, in particular, piston ring end-gaps open up with an absence of heat, wherein more oil is drawn upward into the combustion chamber. CCO technology is also present in "Jacob-brake" and "engine-brake"applications, having been used for years to assist heavily loaded trucks and heavy-duty vehicles in stopping. When Jacob-brake activation occurs, the deactivated cylinders will allow the engine to "self-brake" on a downhill slope by reducing engine pumping efficiency in the non-firing cylinder(s). CDA/CCO also occurs in diesel engines during particulate filter regeneration, to burn off accumulated particulate matter.

Zheng Ma PhD, of General Motors addresses this issue of oil leakage in SAE Technical Paper 2010-01-1098, "Oil Transport Analysis of a Cylinder Deactivation Engine". Ma suggests a redesign of the piston lands and drain-holes and, in particular, limits the oil supply to the bottom of the piston. Takashi Inoue of Toyota Motor Corp authored an SAE Paper "Study of Oil Consumption of Automotive Engine" ISSN: 0148-7191, describes transient oil consumption during engine-brake conditions, wherein a higher intake manifold vacuum occurs, creating a transient reverse oil flow upward in the cylinder bore. Engine manufacturers design their piston ring packages primarily for the engine operating in an active "firing state"and not in a "deactivated state", which may lead to an oil leakage issue.

One methodology to limit oil leakage is a re-design of ring sets and pistons that seal more effectively for both active and deactivated firing states. A number of years ago, GM experienced a growing issue with their version of cylinder deactivation, termed "Active Fuel Management". Designers learned that deactivating cylinders on long highway drives definitely reduced fuel consumption, however, inactive pistons still reciprocate in the cylinder bores and generate heat from frictional forces. Lubrication over spraying led to "cooking" the oil on a hot piston, resulting in a buildup of burnt oil deposits on the piston rings, causing continuous oil consumption. GM introduced a shield to keep the oil from "slugging-up" the piston bore. Although the above prior art and research has improved the understanding of excessive lubrication during cycles of cylinder inactivity (no pulse width), idle conditions and, light load scenarios, the leakage of lubrication oil to the combustion chamber, continues to be a sizeable issue.

Another concept addressing this issue is publication US2020/0018197A1 to McCarthy, Jr. PhD et al. of Eaton Ltd. , wherein the intake and exhaust valve sequencing is manipulated during cylinder deactivation. The motivation is to promote "increased in-cylinder pressure" to reduce oil accumulation in the cylinder.

U.S. Pat. No. 8,955,474 B1 to Derbin et al. generally describes a system for reducing soot in diesel engines; however, there is no method or system of addressing lubrication mitigation in deactivated cylinders, cylinder cutout, engine-braking and, in particular, for when deactivation is rotated to other active cylinders in a plurality of rotation sequences.

Two primary challenges are associated with current lubrication mitigation schemes. First, they may not effectively cover all ranges of load expectations of the engine and, secondly, cylinder deactivation lubrication ends up becoming complicated and cumbersome requiring expensive electro-mechanical infrastructure. Hence, there is a continuing need for a robust control methodology to lubricate the cylinder assembly throughout the operation of all engine conditions of load/speed and, in particular, during cylinder deactivation, to mitigate excessive reverse flow of oil to the combustion chamber (firedome).

SUMMARY

It is therefore an object of the present invention to provide a mitigated means to lubricate the piston dome underside and cylinder wall for selected deactivated cylinders and, additionally, for all remaining active cylinders. The present invention comprises an oil sump, an oil pump, oil lubricating distribution tube (common-rail manifold), an electro-mechanical solenoid capable of being pulse-width-modulated (pwm) and a flow nozzle directed to the piston dome underside. In addition, an engine control module "ECM", including a plurality of sensors and tables, including a throttle position sensor, rpm sensor, coolant temperature sensor, oil pressure sensor, map sensor, injector base fuel table, timing table and, a governor map is generally used. It is important to note that engine manufacturers incorporate various sensors to measure and manage their own specific fuel injection control systems, and may differ somewhat from manufacturer to manufacturer.

Operation of a modern electronically controlled fuel injected internal combustion engine, requires the operator to press on the vehicle pedal, wherein the ECM reads this pedal position as a requested throttle position and additionally, engine speed (RPM) is measured by a magnetic pickup from a single or multi-toothed gear. A (TORQUE-RPM) table incorporates a non-volatile memory array of desired injector pulse widths, commonly termed an (EFI BASE) table and, specifically, these pulse widths translate to a "duty cycle" value. A pulse-width-modulated (PWM) signal electronically modulates the fuel injector's plunger that is controllable with a duty cycle between (0 to 100%). The "ON" time of an electronic fuel injector, is the percentage "duration" of the duty cycle that the spring-loaded injector allows fuel delivery to the combustion chamber. The finalized fuel injection duty cycle dictates the desired engine brake torque to the vehicle drivetrain and represents the total horsepower demands placed on the engine pistons, engine components, and all vehicle drive train components. A typical ECM will provide a proportional-integral-derivative (PID) control in a closed-loop fashion, to each cylinder's fuel injection drive and feedback circuitry. The ECM controls each fuel injector independently, and follows the desired dictates of the fuel table, filled with "finalized" duty cycle values.

The present invention leverages the modern fuel injection base table data value(s), wherein a requested table value is evaluated by a software matching-filter and, specifically, adjusts the value to one of five specific duty cycle values that most closely matches the "requested" value. A lubrication module performs the filter and adjustment control, wherein, each requested injector fuel duty cycle value becomes a requested "oil jet" duty cycle, determined from five distinct choices (Cases). A summing junction and a proportional-integral (PI) stage, accept this modified duty cycle, wherein the signal drives the oil solenoid valve that delivers lubricating oil through its respective flow nozzle. In addition, the nozzle is preferably directed upward to the piston underside, wherein, more than one nozzle may exist per cylinder. A 100% duty cycle represents full flow and, in particular, allows full volumetric pump flow of oil through the nozzle to the piston dome underside, i.e. cylinder assembly. A majority of diesel engines and a percentage of high output powered gasoline engines incorporate oil-lubrication jet nozzles for piston lubrication and allow the pump to operate at full flow based on engine speed. In general, rated speed will yield full pump flow. The widely used fixed and volumetric pump flow designs accommodate lubrication needs for worst-case engine operating conditions and, specifically, may create an over-lubricating issue for lower imposed loads.

The present invention "smart firedome" accommodates lubrication for light loads and, in particular, detects cylinder deactivation as a (0% fuel injection duty cycle). This "injector shutoff state" dictates a substantially lowered quantity of oil delivered to the piston underside and, specifically, just enough to overcome the cylinder bore frictional forces. Again, when a cylinder is not firing (deactivated or inactive), the cylinder's combustion chamber temperature and pressure is lowered and the need for lubrication to the piston dome underside and cylinder wall is substantially reduced. It will be appreciated this present embodiment mitigates oil usage for the entire spectrum of the piston dome underside and cylinder wall with an improvement upon present lubrication methods and, in particular, does so by reducing costs with a minimal amount of hardware/software infrastructure modifications.

BRIEF DESCRIPTION OF THE DRAWINGS

For a more complete understanding of this disclosure, reference is made to the following description, taken in conjunction with the accompanying drawings, in which.

DETAILED DESCRIPTION

The embodiment described in the present invention is by way of illustration only and should not be construed in any way, to limit the scope of the invention. Those skilled in the art will understand that the principles of the present invention may be implemented in any type of suitably arranged device or system. The drawings may not necessarily be to scale and certain features illustrated in a schematic form. As used in the specification and claims, for the purpose of describing and defining the disclosure, the term "substantially" is used herein to represent the degree by which a quantitative representation may vary from a stated reference without resulting in a change in the basic function of the subject matter at issue. "Comprise", "include", and/or plural forms of each are open-ended, include the listed parts, and can include additional parts that are not listed. For purposes of clarity, the same reference numbers apply to FIGS. 1 and 2, wherein, FIG. 3 is a software flowchart, further defining module 68 of FIG. 2. As used herein, the term module refers to an application specific integrated circuit (ASIC), a processor that is shared, dedicated, or part of a group and memory that executes firmware, software, combinational logic circuits that perform the functionality of this invention. In addition, the processes of lubricating and oiling may be used interchangeably, wherein both processes function to lubricate and cool the piston(s) and cylinder wall(s).

Figure 1:
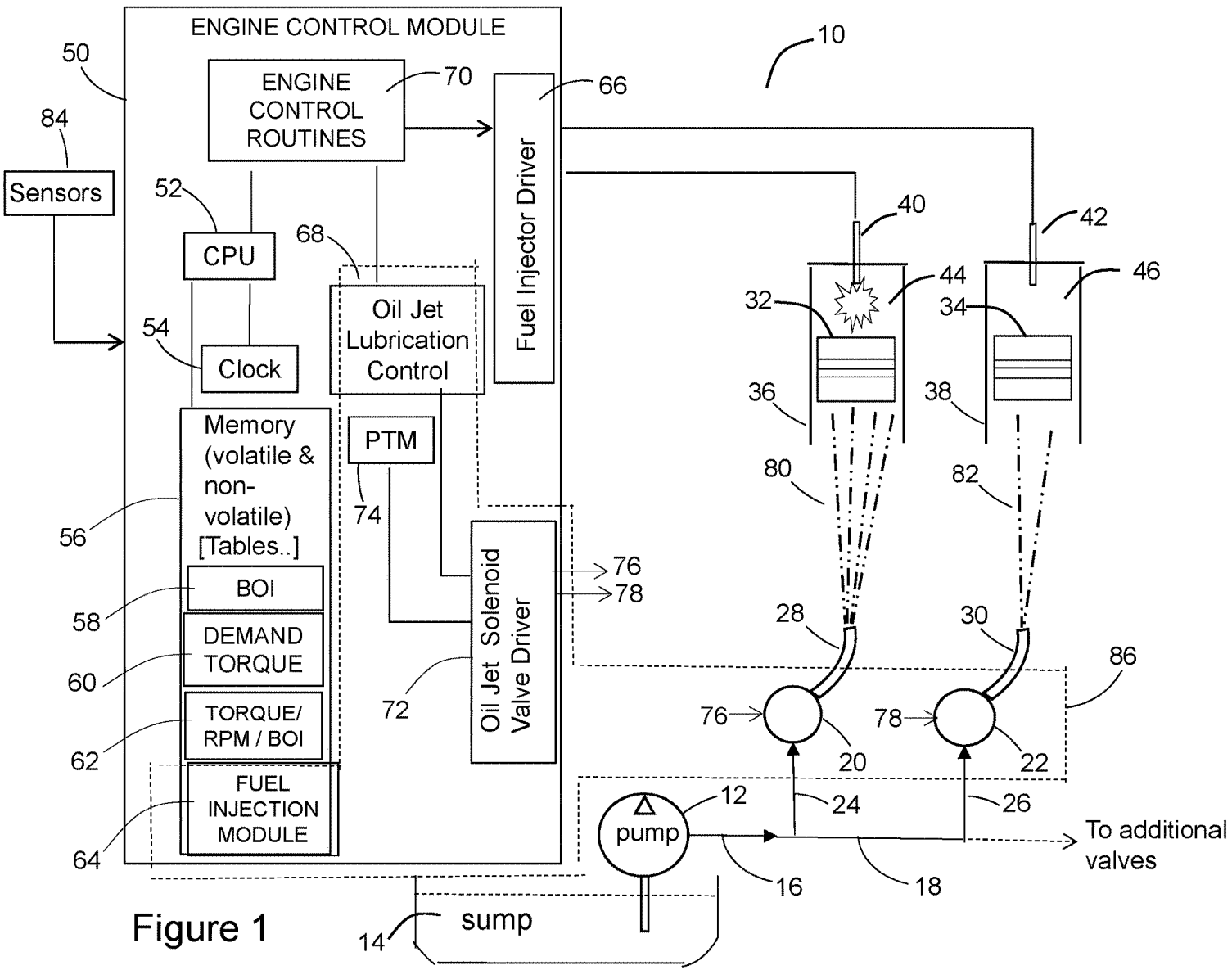
FIG. 1 depicts a schematic illustration embodying the present invention.

FIG. 1 includes a compression-ignition and/or a spark-ignition, 2-cylinder configuration engine 10, that comprises an oil lubricating, fixed or variable displacement pump 12, that pumps oil from the sump 14 through a flow passage 16 to a "common-rail oil manifold" 18, to oil jet solenoid(s) 20, 22. Common-rail 18 is in communication to inlet oil port(s) 24, 26 of oil jet solenoid(s) 20, 22 respectively. Oil jet nozzle(s) 28, 30 are in communication with each outlet oil port of each solenoid valve 20, 22 respectively and, illustrates delivery of oil to "additional valves" as necessary. Oil jet nozzle(s) 28, 30 are preferably directed upward to piston dome underside(s) 32, 34 of cylinder(s) 36, 38. Piston dome(s) 32, 34 move up and down within piston cylinder(s) 36, 38 and, fuel is injected through electronic fuel injector(s) 40, 42 into combustion chamber(s) 44, 46, wherein combustion chamber (firedome) 44 illustrates substantial combustion activity.

ECM 50 comprises a CPU 52, System Clock 54, Memory 56 (includes RAM, EEPROM, FLASH), memory look-up tables, including BOI 58, DEMAND TORQUE 60, TORQUE/RPM/BOI 62, FUEL INJECTION MODULE 64, Fuel Injector Driver 66 and the fuel injector(s) 40, 42. The Oil Jet Lubrication Control 68, is in communication with both the ENGINE CONTROL ROUTINES 70 and the Oil Jet Solenoid Valve Driver 72. A programmable timer module (PTM) 74 is also in communication with the Oil Jet Solenoid Valve Driver 72 and, specifically, is responsible for creating the base frequency and duty cycle modulation for driving the solenoid valve(s) 20, 22. Electronic control signal lines 76, 78 interface the oil jet module 72 to solenoid valve(s) 20, 22. It will be appreciated that a "shunt current"circuit exists in Block 72 (not illustrated) for each oil jet solenoid 20, 22 as a method to sense feedback current. Each oil jet solenoid is controlled independently to maintain the "desired" oil jet duty cycle in a Proportional/Integral (PI) control-loop (not illustrated in FIG. 1). In addition, Block 72 includes a logic output solenoid valve drive circuit that can sense a "stuck high" or "stuck low" voltage level condition, wherein ECM 50 is placed in a "limp-home-mode" (not illustrated). An oil spray pattern 80, 82 is illustrated flowing different quantities of oil to piston dome underside(s) 32, 34, and in particular, is based on the commanded duty cycle of the respective oil jet solenoid valve(s) 20, 22.

The SENSORS 84 block represents sensors commonly used on spark-ignition and compression-ignition engines 10 and may include but not limited to manifold absolute pressure (MAP), engine speed (RPM), vehicle throttle position, engine oil temperature, oil pressure, coolant temperature (individual sensors not illustrated). Note, the dashed boundary line (86) within ECM 50 and Engine 10, indicates the "smart firedome" system.

Figure 2:
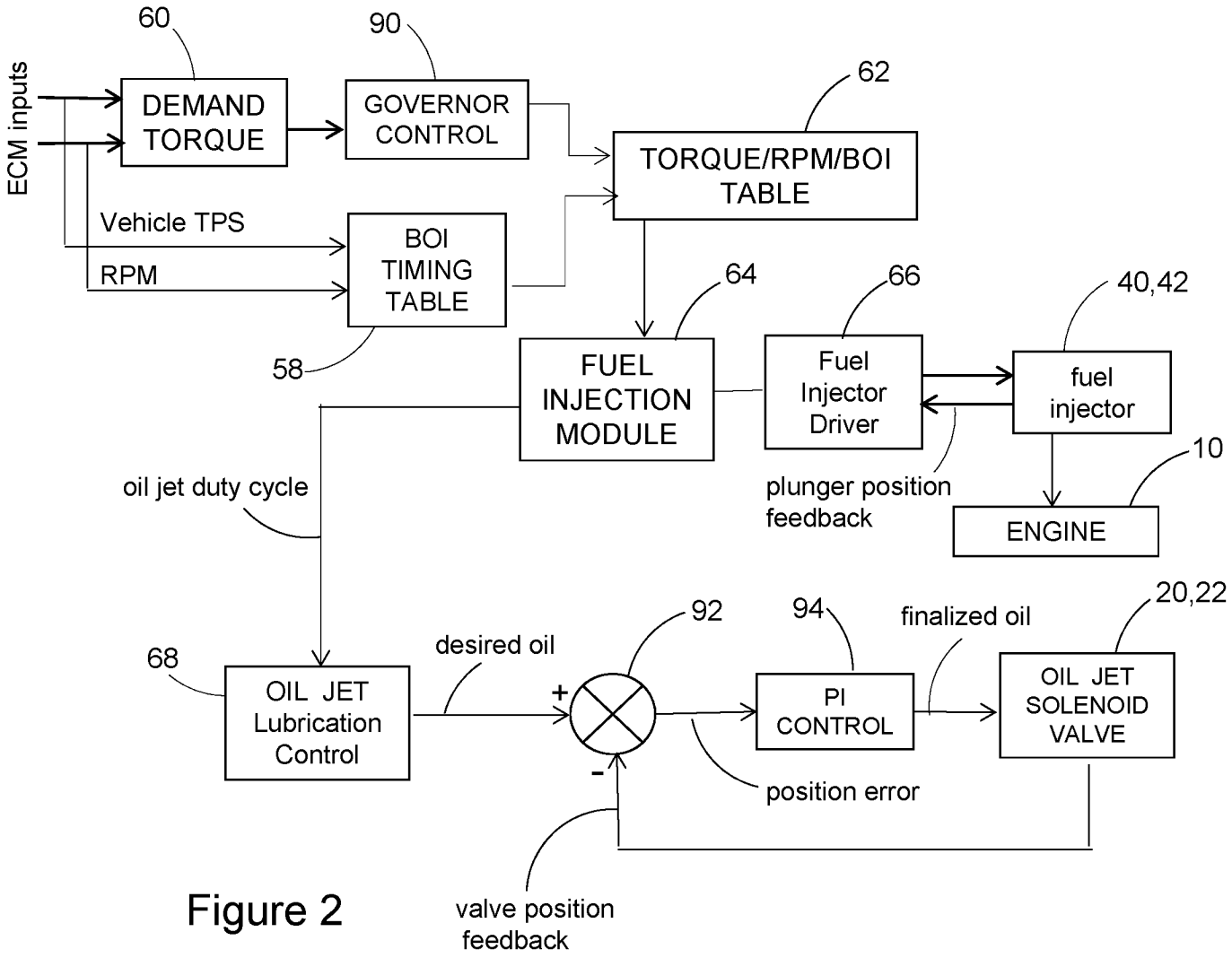
FIG. 2 depicts a block diagram of the oil mitigation control strategy for use with the present invention.
Figure 3:
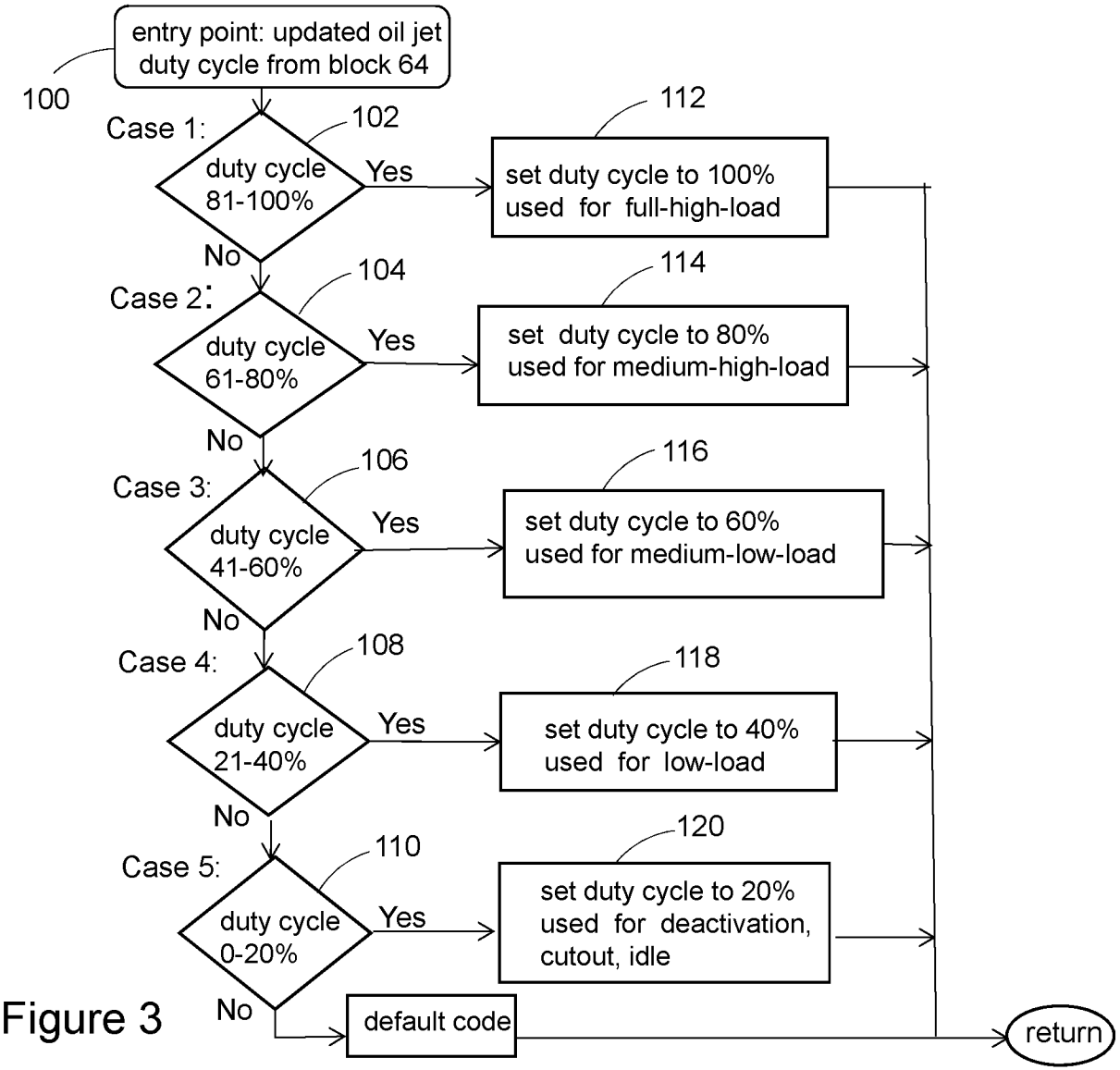
FIG. 3 is a flowchart illustrating the software lubrication/oiling rules controlling the oil jet solenoids of the present invention.

Turning to FIG. 2, the electronic control module controls the fuel to the engine, based on reading ECM Inputs of vehicle throttle position (TPS) and engine speed (RPM) and then locates and retrieves corresponding EEPROM table values of both DEMAND TORQUE 60 and BOI 58. GOVERNOR CONTROL 90 makes a determination if adjustments are required to the demand torque value, i.e., smoke limiting, over temperature conditions, over-load torque limiting, and other engine conditions. From here, the non-volatile TORQUE/RPM/BOI 62 module calculates a final pulse width and converts the value to a percentage duty cycle for the FUEL INJECTION MODULE 64. The Fuel Injector Driver 66 receives a duty cycle modulated signal from the FUEL INJECTION MODULE 64 and provides the fuel injector(s) 40, 42 the proper fuel to supply the ENGINE 10. The fuel injector(s) 40, 42 provides a "plunger position feedback" signal to the Fuel Injector Driver 66, wherein plunger position sensing is managed through a shunt current feedback circuit (not illustrated).

The OIL JET Lubrication Control 68 receives a continuous updated "oil jet % duty cycle value" representing fuel injection (not illustrated). This value is evaluated through a set of software "lubricating/oiling rules" and, specifically, evaluated for equivalence by a set of five specific "Case" scenarios (discussed in FIG. 3). Each Case statement "evaluates" for a match and then sets the updated value of the duty cycle to one of five specific discrete duty cycles (see FIG. 3), referenced in FIG. 2 as "desired oil". Summing junction 92 receives the "desired oil" duty cycle at the "positive" input, wherein the output of Summing junction 92 becomes the "position error" signal driving the input of the PI Control 94. The output of PI Control 94 becomes the "finalized oil" signal to duty cycle modulate solenoid valve(s) 20, 22, wherein, "valve position feedback" completes the closed-loop through the "negative" input of Summing junction 92. Valve position feedback is sensed by a shunt circuit within the Oil Jet Solenoid Valve Driver 72, through interface signal connections 76, 78 (see FIG. 1) of solenoid valve(s) 20, 22. As an example, Texas Instrument manufactures an ASIC that has a "Back-EMF" sensing circuit to measure the average current draw of a solenoid's plunger (armature) for modulating an electro-mechanical solenoid. The OIL JET Lubrication Control 68 includes a plunger-position-loop-gain term, position-proportional-gain term, position-integral-gain term (not illustrated) and, specifically, located in a non-volatile memory table 56 (FIG. 1).

Turning now to FIG. 3, block 100 defines a software entry point for evaluating the fuel injection duty cycle (same as oil jet % duty cycle) that becomes filtered by dropping through "Case" statements (1 through 5) and evaluated for a match within the duty cycle range, defined in each Case statement. As an example, if the fuel injection duty cycle is 82% at the input of Case 1: (102), then 82% falls between the defined values of (81-100%) and will take the "Yes" path to block 112. Block 112 is responsible for setting the "finalized oil" duty cycle to a value of 100% and, in particular, shall flow an oil pattern 80 (FIG. 1) representative of a "full-high-load"point. Looking at another example, if a commanded fuel injection duty cycle of 18% is retrieved at software block 100, then Case 1: (102), Case 2: (104), Case 3: (106), and Case 4: (108) are evaluated to take the "No" branch. Case 5: (110) decision branch, evaluates 18% to be between the values of (0-20%) and takes the "Yes"branch to block 120, wherein, the "finalized oil" duty cycle is set to 20%. It will be appreciated that the present invention has the ability to automatically sense (detect) a cylinder-cutout and/or a cylinder-deactivation state of the engine (0% fuel injection duty cycle) and, specifically adjusts the "finalized oil" duty cycle to be 20%. Turning again back to FIG. 1, oil pattern 82 illustrates an engine in a deactivated state (note: the absence of combustion chamber 46 activity). A duty cycle of 20% provides a substantially reduced level of lubrication for deactivation, cutout, and idle, compared against present oil mitigation strategies on the market, however; shall provide a safety margin to overcome the frictional forces generated by the reciprocating piston with fuel injection shut-off. The present invention provides for generating a total of five discrete oiling flow quantities, i.e., 100% at block 112, 80% at block 114, 60% at block 116, 40% at block 118, and 20% at block 120. Discrete oiling ranges provide for overlap with many different engine types, horsepower ranges, and variations in engine ECM calibrations and, in particular, designed to provide a "lead" control factor to provide a level of safety margin to prevent under-oiling for all load ranges. The present invention provides for intermediate levels of mitigated oiling and, specifically, Case 2 (114) provides for oiling at loads less than or equal to "medium-high-load", wherein Case 3 (116) for loads less than or equal to "medium-low-load" and, Case 4 (118) for oiling less than or equal to "low-load" loads. The present disclosure mitigates oil usage to cover all ranges of engine loading and rpm and, in particular, substantially reduces oil lubrication needs for cylinder cutout, cylinder deactivation, Jacob-brake, engine-brake applications, wherein, fuel injection is shutoff While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the following claims.

What is claimed is:

1. A system for mitigating the amount of oil that is consumed by the combustion chamber during cylinder deactivation, cylinder cutout, Jacob-braking, engine-braking functionality of an electronic fuel injected internal combustion engine, including both compression-ignited and spark-ignited, an engine control system that manages fuel injection on an individual cylinder basis and, sensors that measure a plurality of engine control parameters including rpm, vehicle throttle position and, manifold pressure, comprising; at least two cylinders; and an oil sump and oil pump supply system to provide lubrication-cooling oil through a solenoid valve control system in communication to an oil jet nozzle to the piston dome underside and cylinder wall of each individual cylinder; and an oil mitigation control system in communication to the engine control system, wherein the lubricating oil delivered to each cylinder assembly is adjustable; and said oil mitigation control is adapted to sense and receive a continually updated fuel injector pulse width for each fuel injector, including a routine to convert said pulse width to an oil duty cycle Percentage value for each cylinder for controlling a solenoid valve in communication with each individual activated/deactivated cylinder, whereby this oil duty cycle percentage value operates the oil solenoid valve to provide a corresponding let spray to the piston underside; and said oil mitigation system uses said fuel injection pulse width table to create an oil jet duty cycle table, scaled linearly, wherein a zero or substantially low pulse width represents a 0% or substantially low oil jet duty cycle and, a maximum pulse width translates to a 100% oil jet duty cycle, providing full oil flow to the piston underside; and said oil mitigation system further comprising a software evaluation-matching filter, to route said oil jet duty cycle value to each cylinder, to one of a plurality of oil flow ranges to mitigate lubrication over a full spectrum of said cylinder assembly load demands for each activated/deactivated cylinder; and said oil mitigation system further comprising a range configured to provide a deactivated cylinder the minimum quantity of lubrication oil, whereby a cylinder in deactivation, requires the slightest quantity of lubrication to overcome frictional forces.

2. The system of claim 1, wherein said oil mitigation control comprises at least one solenoid valve for each cylinder, preferably configured for armature or plunger position feedback.

3. The system of claim 1, further comprising a plurality of said ranges configured to accommodate lubrication for deactivation and idle, low-load, medium-5 low-load, medium-high-load and, full-high-load.

4. A method of mitigating lubricating oil from entering the combustion chamber, in a fuel-injected, spark-ignited, compression-ignited, internal combustion engine, having at least two cylinders comprising cylinder deactivation, cylinder cutout, Jacob-braking, engine-braking technology, the method comprising the steps of: sensing an operator demand requesting various power levels for lubricating each cylinder assembly; and providing a plurality of power level bands or ranges anticipated in providing lubrication for operating said cylinder assembly; and mitigating lubricating oil to said cylinder assembly in both deactivated and activated states, whereby delivering oil in a closed-loop means to both deactivated and activated cylinders, wherein reading a continually updated value of pulse width from a base fuel infection table for determining said power level exerted on said cylinder assembly, further comprising a means of converting said fuel injection pulse width to a duty cycle value for controlling a pulse-width- modulated solenoid valve, whereby said duty cycle values reflect the lubrication Quantity of oiling to manage the forces exerted on said cylinder assembly, further organizing said duty cycle values generated by said fuel infection system, to a table, preferably comprising five groupings of twenty duty cycle values each, in ascending order, whereby said duty cycle values are ordered from zero to one hundred percent, and wherein mitigating lubrication to said cylinder assembly, comprises controlling lubricating oil through said solenoid valve, through a flow nozzle pointing toward the piston dome underside and cylinder wall assembly.

5. The method of claim 4, wherein each said grouping is comprised of a 30 dominant lubricating duty cycle template value predetermined in a non-volatile table, wherein lubrication is delivered preferably by five distinct duty cycle values, 20%, 40%, 60%, 80% and 100%, respectively placed in said groupings called deactivation-idle, low-load, medium-low-load, medium-high-load, full-high-load.

6. The method of claim 5, further comparing each incoming duty cycle value through a software evaluation mechanism such that said incoming duty cycle value is assigned to the closest of said five dominate lubrication duty cycle values, whereby the lubrication quantity will closely align with said cylinder assembly's exerted load.

7. The method of claim 6, wherein said incoming duty cycle of 0% indicates a cylinder undergoing a state of deactivation or inactivity, whereby lubricating said cylinder assembly is substantially reduced.

8. The method of claim 4, wherein closing the loop around one of said five dominant desired oiling duty cycles, using a proportional-integral control, whereby allowing for ample range overlap for the entire imposed load spectrum.

9. The method of claim 8, wherein position feedback for said solenoid valve's plunger is managed by measuring the shunt current draw comprising a position loop gain term, a position proportional gain term and, a position integral gain term.

* * * * *